US010702072B2

(12) United States Patent
Liu

(10) Patent No.: US 10,702,072 B2
(45) Date of Patent: Jul. 7, 2020

(54) BEDDING ASSEMBLY

(71) Applicant: Nai-Yu Liu, Taichung (KR)

(72) Inventor: Nai-Yu Liu, Taichung (KR)

( * ) Notice: Subject to any disclaimer, the term of this patent is extended or adjusted under 35 U.S.C. 154(b) by 243 days.

(21) Appl. No.: 15/844,667

(22) Filed: Dec. 18, 2017

(65) Prior Publication Data

US 2019/0183252 A1 Jun. 20, 2019

(51) Int. Cl.

| | |
|---|---|
| ***A47C 21/02*** | (2006.01) |
| ***A47G 9/02*** | (2006.01) |
| ***A47G 9/04*** | (2006.01) |
| ***A47G 9/08*** | (2006.01) |

(52) U.S. Cl.

CPC ..... *A47C 21/022* (2013.01); *A47G 9/02* (2013.01); *A47G 9/0207* (2013.01); *A47G 9/0261* (2013.01); *A47G 9/04* (2013.01); *A47G 9/083* (2013.01)

(58) Field of Classification Search

CPC ..... A47C 21/02; A47C 21/022; A47C 20/027; A47G 9/02; A47G 9/0207; A47G 9/0238; A47G 9/0246; A47G 9/0261; A47G 9/04; A47G 9/083; A47G 2009/0269

See application file for complete search history.

(56) References Cited

U.S. PATENT DOCUMENTS 2,400,731 A * 5/1946 Armstrong ..... A47C 27/006 5/500
3,083,378 A * 4/1963 Pursell ..... A47D 15/02 5/498
3,530,487 A * 9/1970 Beer ..... A47G 9/02 5/496
3,857,124 A * 12/1974 Hadley ..... A47C 21/022 5/496
3,965,504 A * 6/1976 Ainsworth ..... A47G 9/02 5/485
4,903,360 A * 2/1990 Friedman ..... A47G 9/02 5/485
5,208,927 A * 5/1993 Lachmar ..... A47G 9/02 5/497
5,566,411 A * 10/1996 Eiler ..... A47G 9/02 5/484
5,666,680 A * 9/1997 Hackett, Jr. ..... A47G 9/0246 5/496
5,794,285 A * 8/1998 Burch ..... A47G 9/02 5/494
6,098,219 A * 8/2000 Milber ..... A47G 9/02 5/494
6,427,266 B2 * 8/2002 Talley-Williams ..... A47G 9/02 5/482

(Continued)

*Primary Examiner* — David R Hare
(74) *Attorney, Agent, or Firm* — Reches Patent

(57) ABSTRACT

A bedding assembly includes a cushion, a cushion cover, a top cover and a coupling unit. The cushion has opposite lateral surfaces. The cushion cover accommodates the cushion and has opposite first and second cover portions that are respectively adjacent to the lateral surfaces of the cushion. The top cover is laid on top of the cushion cover and has opposite first and second side portions that are respectively adjacent to the first and second cover portions of the cushion cover. The coupling unit includes a first coupling subunit that separably couples the first cover portion to the first portion, and a second coupling subunit that separably couples the second cover portion to the second side portion.

6 Claims, 9 Drawing Sheets

(56) References Cited

U.S. PATENT DOCUMENTS

| | | | | |
|---|---|---|---|---|
| 6,490,741 | B1 * | 12/2002 | Wheeler | A47G 9/02 5/494 |
| 8,214,949 | B2 * | 7/2012 | Thompson | A47D 15/001 5/494 |
| 9,955,796 | B2 * | 5/2018 | Schulte | A47C 31/105 |
| 10,368,654 | B2 * | 8/2019 | Sopher | A47C 21/028 |
| 2008/0104751 | A1 * | 5/2008 | Friedland | A47G 9/02 5/502 |
| 2010/0251482 | A1 * | 10/2010 | MacDonald | A47G 9/02 5/494 |
| 2012/0204348 | A1 * | 8/2012 | Bayer | A47G 9/02 5/413 R |

* cited by examiner

BEDDING ASSEMBLY

FIELD

This disclosure relates to a bedding assembly, and more particularly to a bedding assembly having a cushion-accommodating cushion cover and a top cover coupled thereto.

BACKGROUND

Sleeping bags for children have been commonly sought after by parents to prevent a child from kicking off his blanket during sleep. For example, in kindergarten, the child generally needs to prepare his own sleeping bag for taking a nap during naptime.

Referring to FIGS. 1 and 2, a conventional sleeping bag 9 disclosed in Taiwanese Utility Model Patent Certificate No. M335238 includes a main body 91 and a plurality of feathers 92 and downs 93 accommodated inside the main body 9. Since the sleeping bag 9 is insufficient in structural strength to support the reclining body of a child on its own, it is usually placed on a mattress when used at home. However, as mattresses are usually not available when being away from home, such as in kindergarten, the child may not be able to nap comfortably with the sleeping bag 9 lying directly on the floor.

SUMMARY

Therefore, an object of the disclosure is to provide a bedding assembly that can alleviate the drawback of the prior art.

According to the disclosure, the bedding assembly includes a cushion with opposite lateral surfaces, a cushion cover, a top cover and a coupling unit. The cushion cover defines a cushion space that accommodates the cushion, and has opposite first and second cover portions that are respectively adjacent to the lateral surfaces of the cushion. The top cover lies on top of the cushion cover and cooperates with the cushion cover to define a reclining space therebetween, and has opposite first and second side portions that are respectively adjacent to the first and second cover portions of the cushion cover. The coupling unit includes a first coupling subunit that separably couples the first cover portion to the first side portion, and a second coupling subunit that separably couples the second cover portion to the second side portion.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
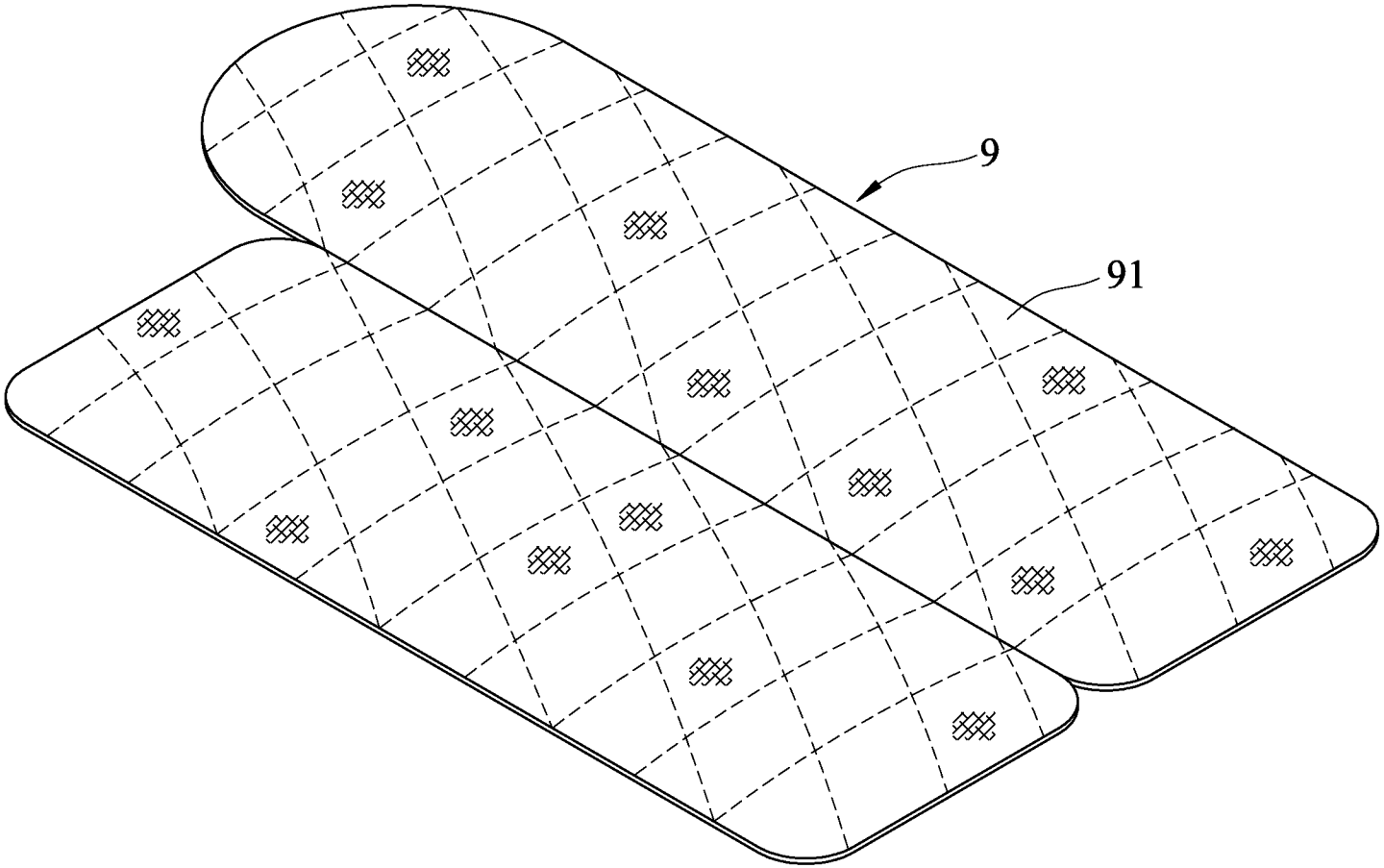
FIG.1 PRIOR ART
FIG. 1 is a perspective view of a conventional sleeping bag.
Figure 2:
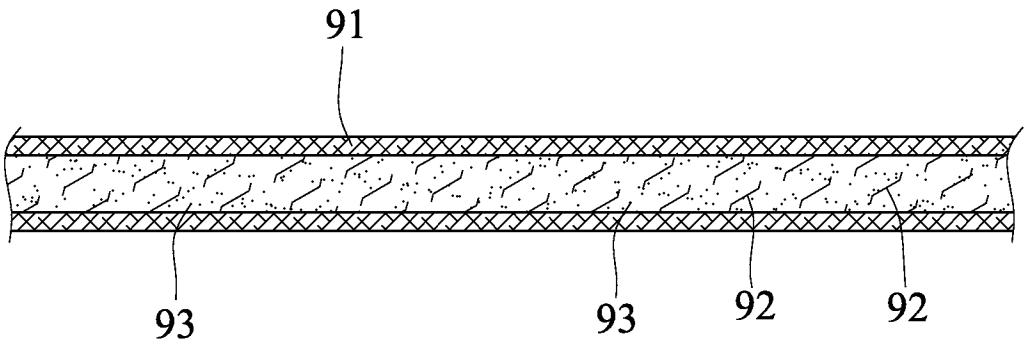
FIG.2 PRIOR ART
FIG. 2 is a fragmentary sectional view of the conventional sleeping bag.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 3:
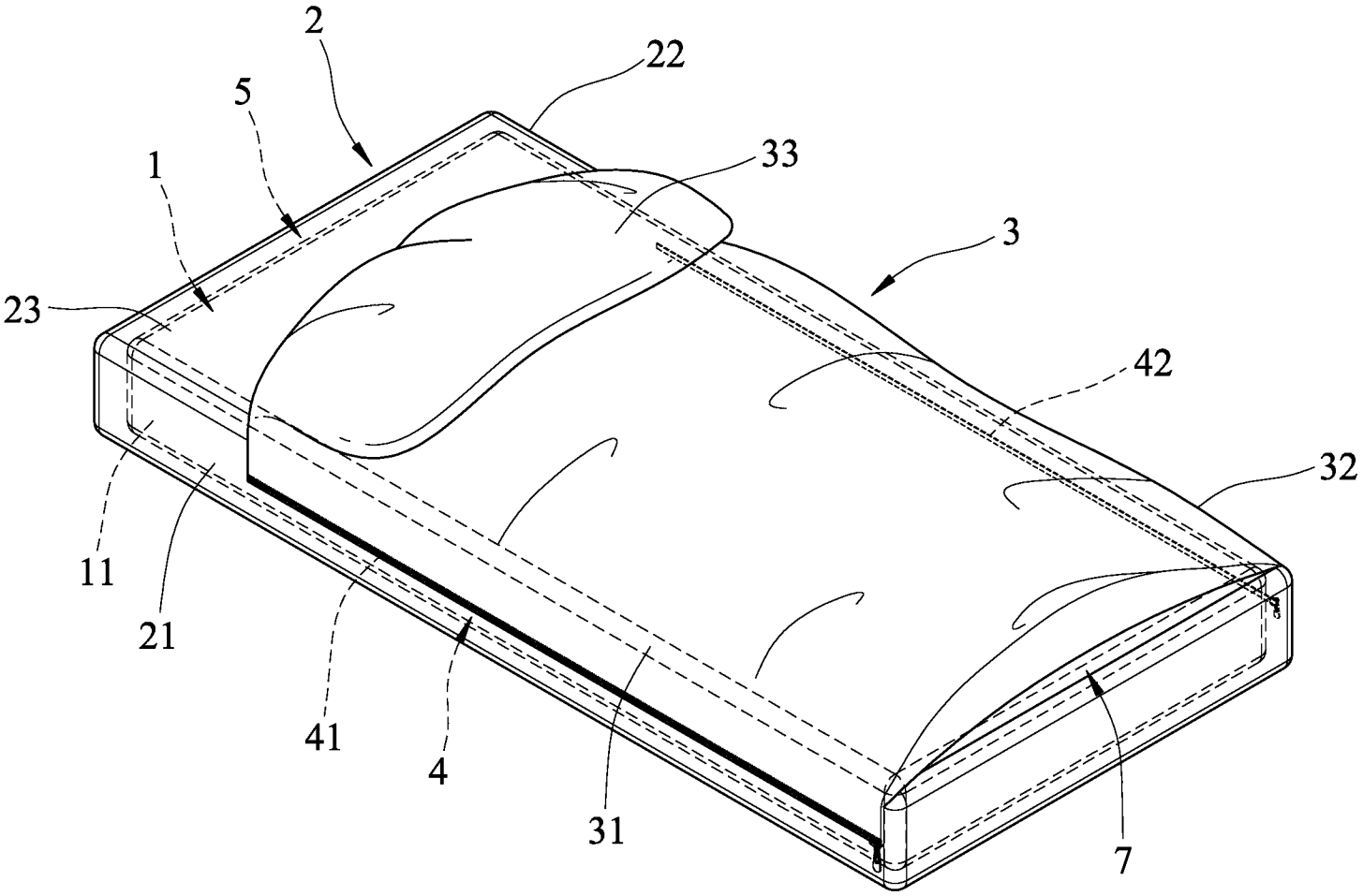
FIG. 3 is a perspective view of a first embodiment of a bedding assembly according to the disclosure.
Figure 4:
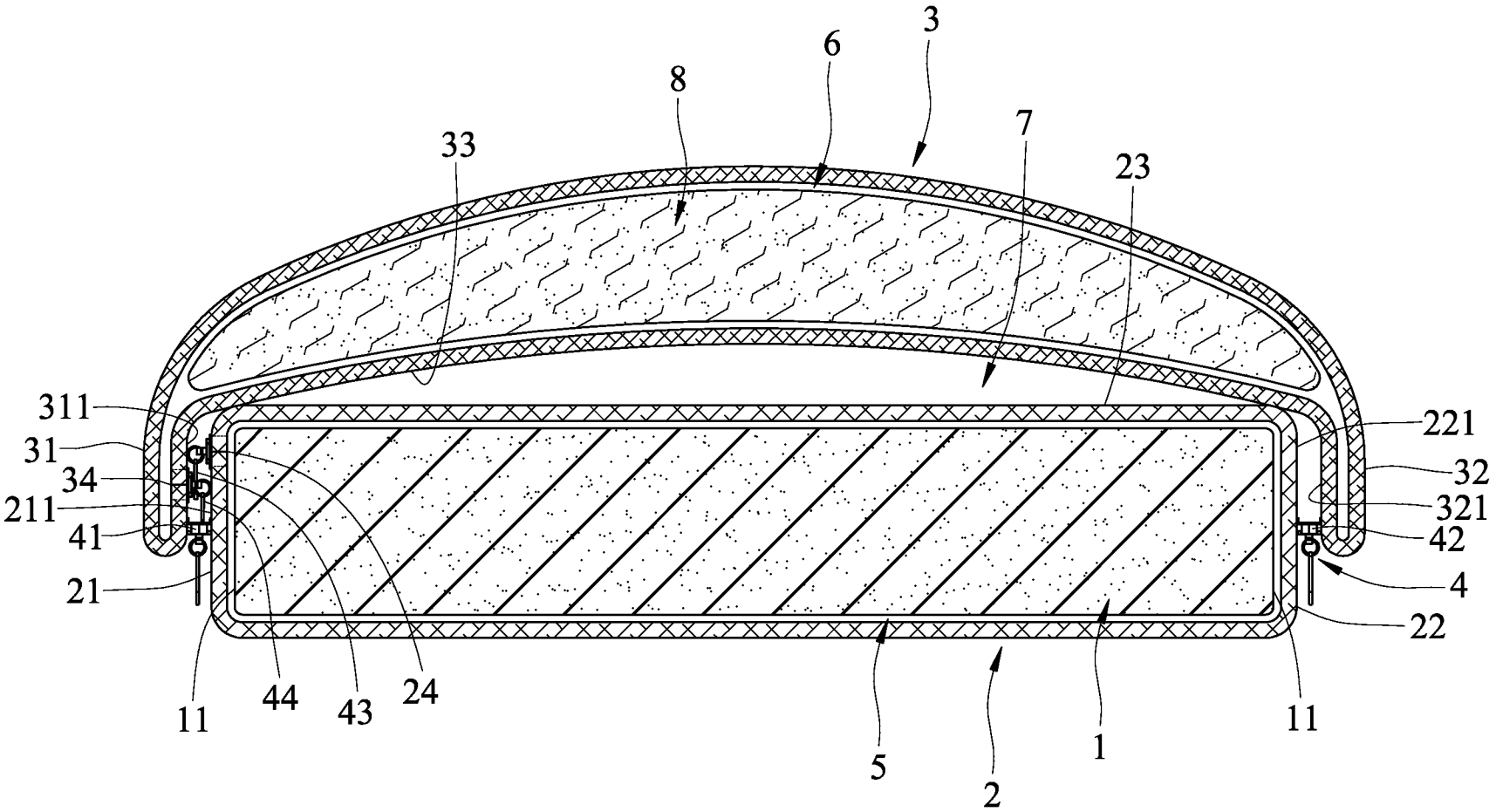
FIG. 4*is* a sectional view of the first embodiment.
Figure 5:
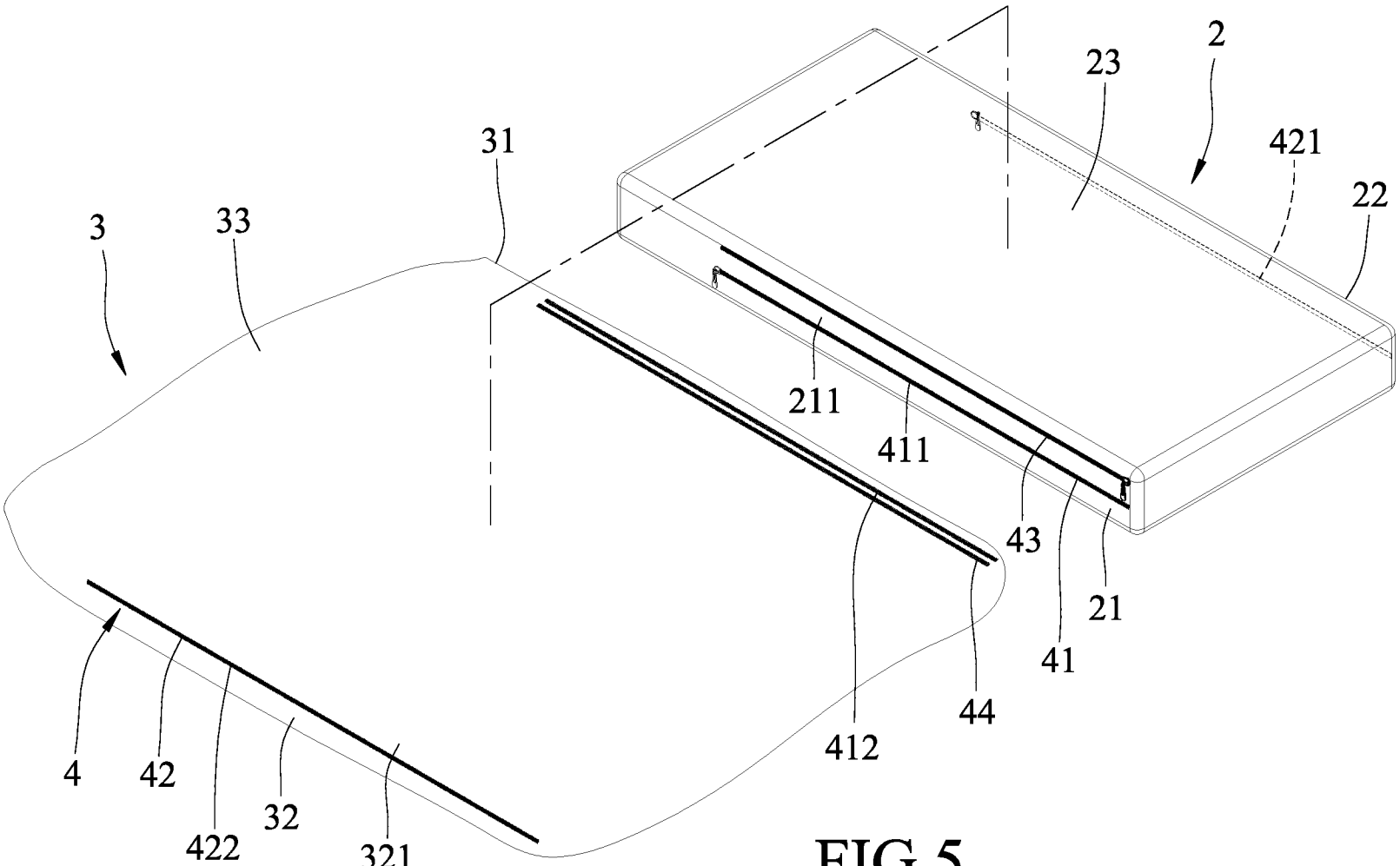
FIG. 5 is an exploded perspective view of the first embodiment.

Referring to FIGS. 3, 4 and 5, a first embodiment of a bedding assembly according to the disclosure includes a cushion 1, a cushion cover 2, a top cover 3, a coupling unit 4, and an insert 8.

The cushion 1 has opposite lateral surfaces 11. It maybe made from polyurethane foam, latex or memory foam. The cushion cover 2 defines a cushion space 5 that accommodates the cushion 1, and has opposite first and second cover portions 21, 22 that are respectively adjacent to the lateral surfaces 11 of the cushion 1, a reclining portion 23 that is located between the first and second cover portions 21, 22 and covered by the top cover 3, and a cover opening 24 that is in communication with the cushion space 5 for permitting removal of the cushion 1 therethrough. The first cover portion 21 of the cushion cover 2 has a first cover area 211 that is covered by the top cover 3, and the second cover portion 22 has a second cover area 221 that is covered by the top cover 3. In this embodiment, the cover opening 24 is exemplified to be formed in the first cover area 211, but it may be formed in the reclining portion 23 or the second cover area 221 instead.

The top cover 3 covers the cushion cover 2 and has a longer width than the width of the cushion cover 2. The top cover 3 is laid on top of the cushion cover 2 and cooperates with the cushion cover 2 to define a reclining space 7 therebetween. The top cover 3 defines an insert space 6 therein that accommodates the insert 8, and has an access opening 34 that is in communication with the insert space 6 to permit removal of the insert 8 therethrough, as well as opposite first and second side portions 31, 32 that are respectively adjacent to the first and second cover portion 21, 22 of the cushion cover 2. The top cover 3 further has a covering portion 33 that is located between the first and second side portions 31, 32 and that covers the reclining portion 23 of the cushion cover 2. The first side portion 31 of the top cover 3 has a first side area 311 that covers the first cover area 211 of the cushion cover 2, and the second side portion 32 of the top cover 3 has a second side area 321 that cover the second cover area 221 of the cushion cover 2. In this embodiment, the access opening 34 is exemplified to be formed in the first side area 311, but it may be formed in the covering portion 33 or the second side area 321 instead. In this embodiment, the insert 8 accommodated in the insert space 6 is exemplified to be removable via the access opening 34. Alternatively, the insert 8 may be designed to be inaccessible from the insert space 6, for example, the insert space 6 may simply be filled with cotton, natural or artificial fibers, and formation of the access opening 34 in the top cover 3 is dispensed.

The coupling unit 4 includes a first coupling subunit 41 that separably couples the first cover portion 21 to the first side portion 31, a second coupling subunit 42 that separably couples the second cover portion 22 to the second side portion 32, a cover opening fastening subunit 43 that is mounted to the cushion cover 2 and that openably seals the cover opening 24, and an access opening fastening subunit 44 that is mounted to the top cover 3 and that openably seals the access opening 34. In this embodiment, each of the first and second coupling subunits 41, 42 is a zipper, and each of the cover opening fastening subunit 43 and the access opening fastening subunit 44 is a zipper. The first coupling subunit 41 has a first zipper portion 411 that is formed in the first cover area 211 of the cushion cover 2 and a second zipper portion 412 that is formed in the first side area 311 of the top cover 3 and that removably couples with the first zipper portion 411. Likewise, the second coupling subunit 42 has a first zipper portion 421 that is formed in the second cover area 221 of the cushion cover 2 and a second zipper portion 422 that is formed in the second side area 321 of the top cover 3 and that removably couples with the first zipper portion 421.

Unlike conventional sleeping bag, the cushion 1 within the cushion cover 2 is able to support the body of a user inside the reclining space 7 to ensure his comfort. Also, when the zippers of the first and second coupling subunits 41, 42 are properly coupled, the top cover 3 is prevented from being kicked away by the user, thus allowing the reclining space 7 to maintain proper temperature for the user. In addition, with formation of the access opening 34, the content within the insert space 6 of the top cover 3 may be freely adjusted to account for seasonal change. With the top cover 3 properly coupled, the cover opening 24, the access opening 34, the cover opening fastening subunit 43 and the access opening fastening subunit 44 would be hidden from sight to give the bedding assembly a clean and tidy appearance.

Figure 6:
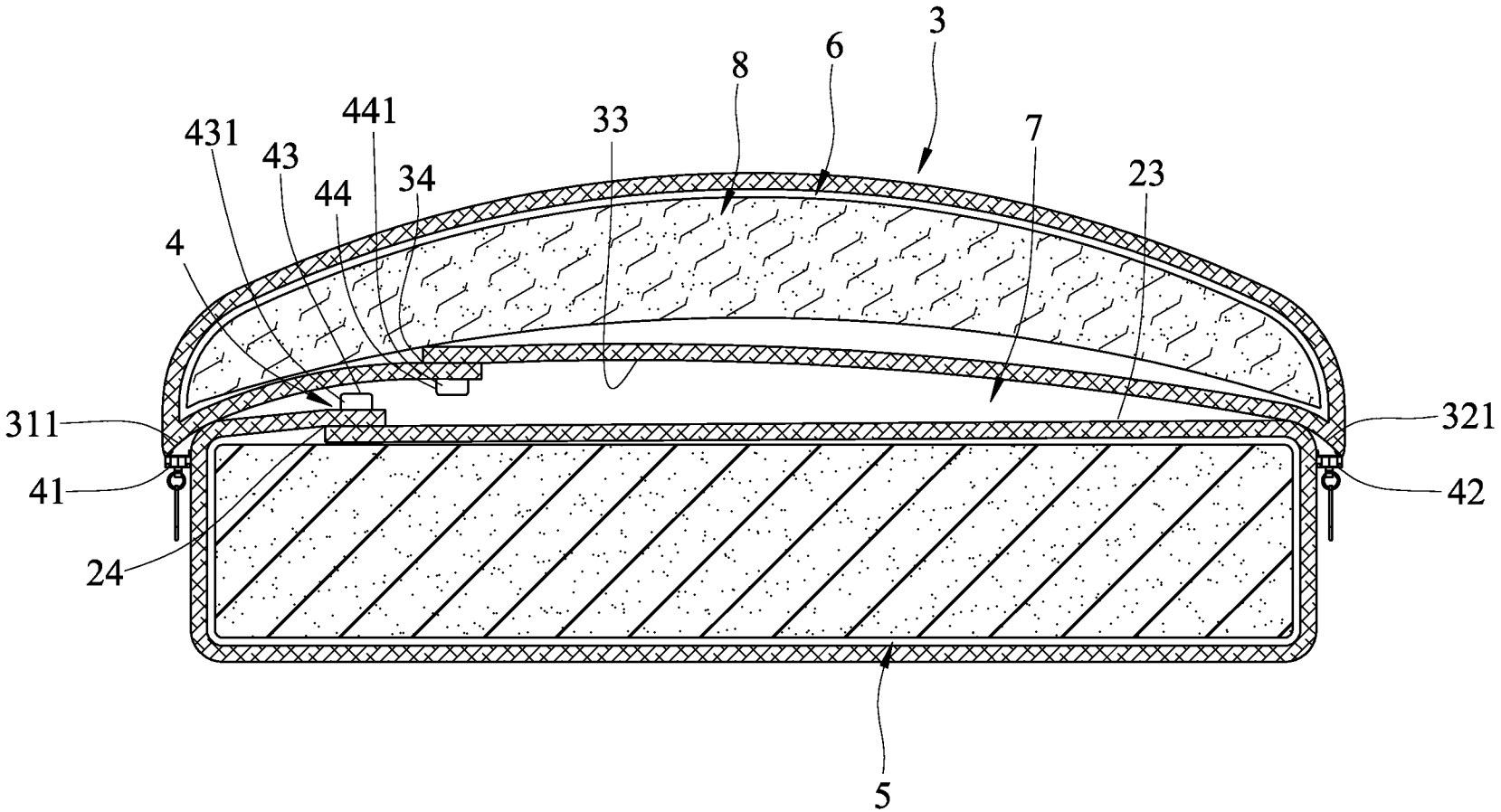
FIG. 6 is a sectional view of a second embodiment of a bedding assembly according to the disclosure.
Figure 7:
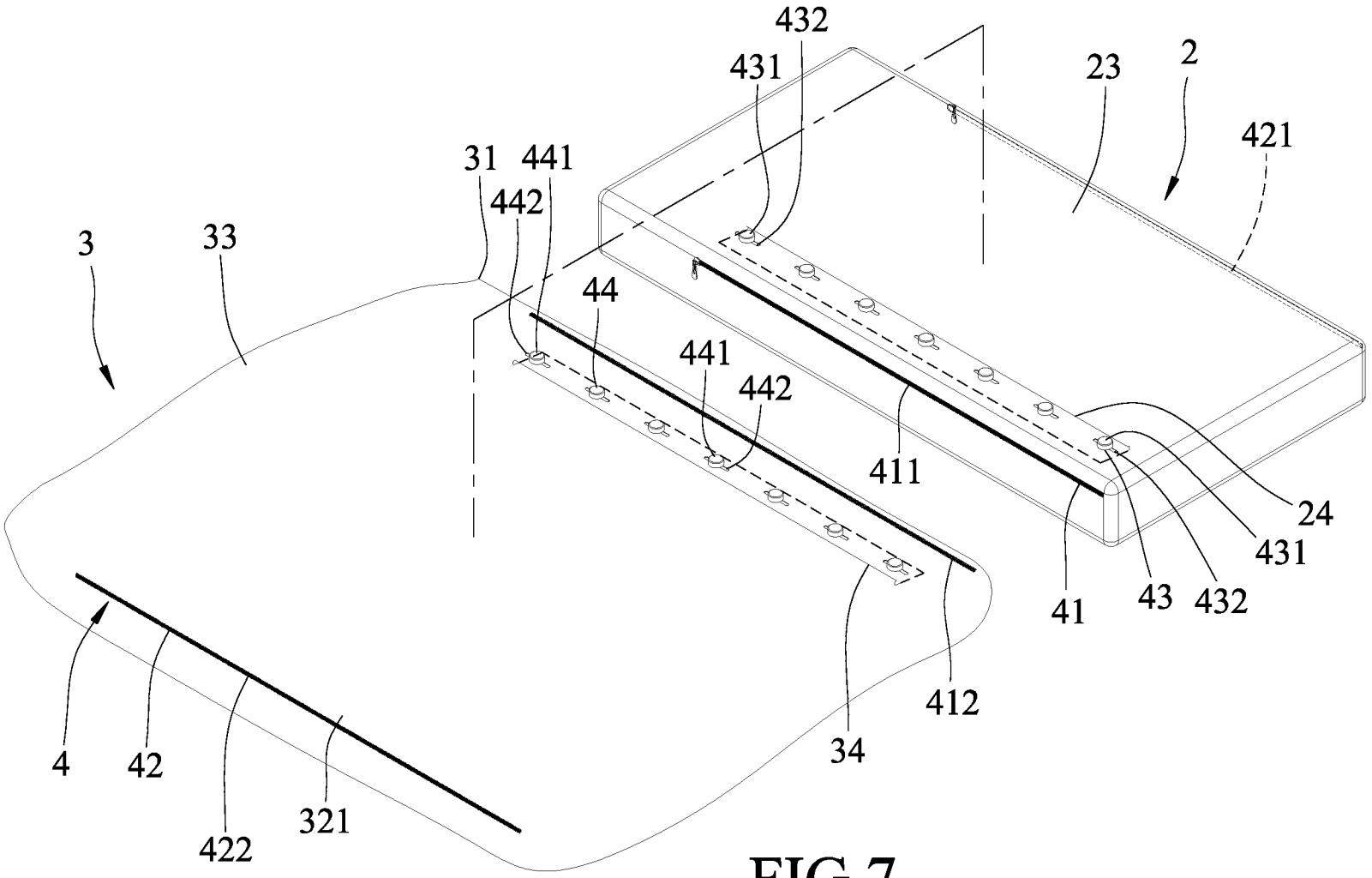
FIG. 7 is an exploded perspective view of the second embodiment.

Referring to FIGS. 6 and 7, a second embodiment of the disclosure is similar to the first embodiment, with the access opening 34 formed at the covering portion 33 of the top cover 3 and the cover opening 24 formed in the reclining portion 23 of the cushion cover 2.

The cover opening fastening subunit 43 has a plurality of cover buttonholes 432 formed in the reclining portion 23 of the cushion cover 2 adjacent to the cover opening 24 and a plurality of cover buttons 431 mounted on the reclining portion 23 that removably engage the cover buttonholes 432. Likewise, the access opening fastening subunit 44 has a plurality of access buttonholes 442 formed in the covering portion 33 of the top cover 3 adjacent to the access opening 34 and a plurality of access buttons 441 mounted on the covering portion 33 that removably engage the access buttonholes 442.

Figure 8:
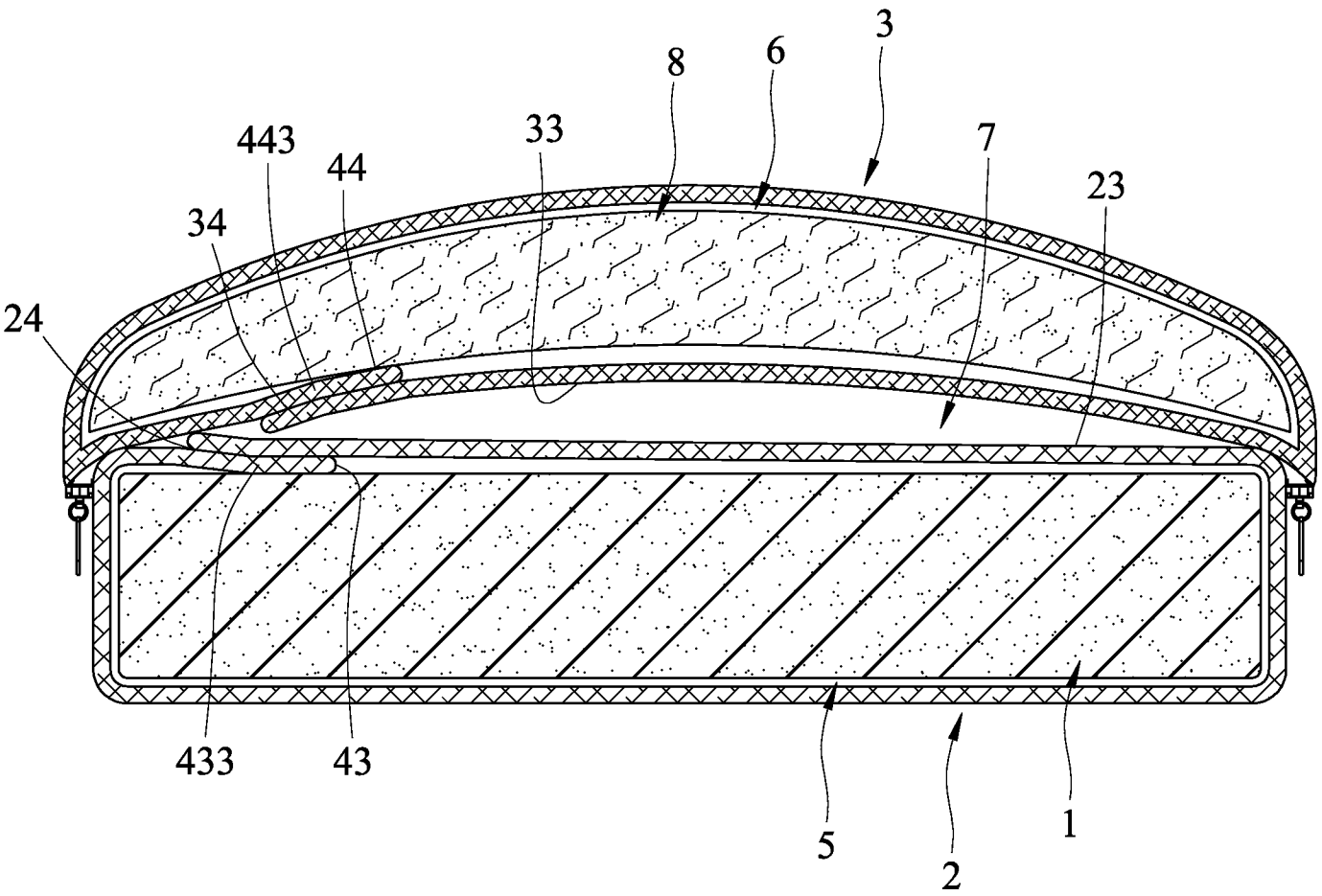
FIG. 8 is a sectional view of a third embodiment of a bedding assembly according to the disclosure.
Figure 9:
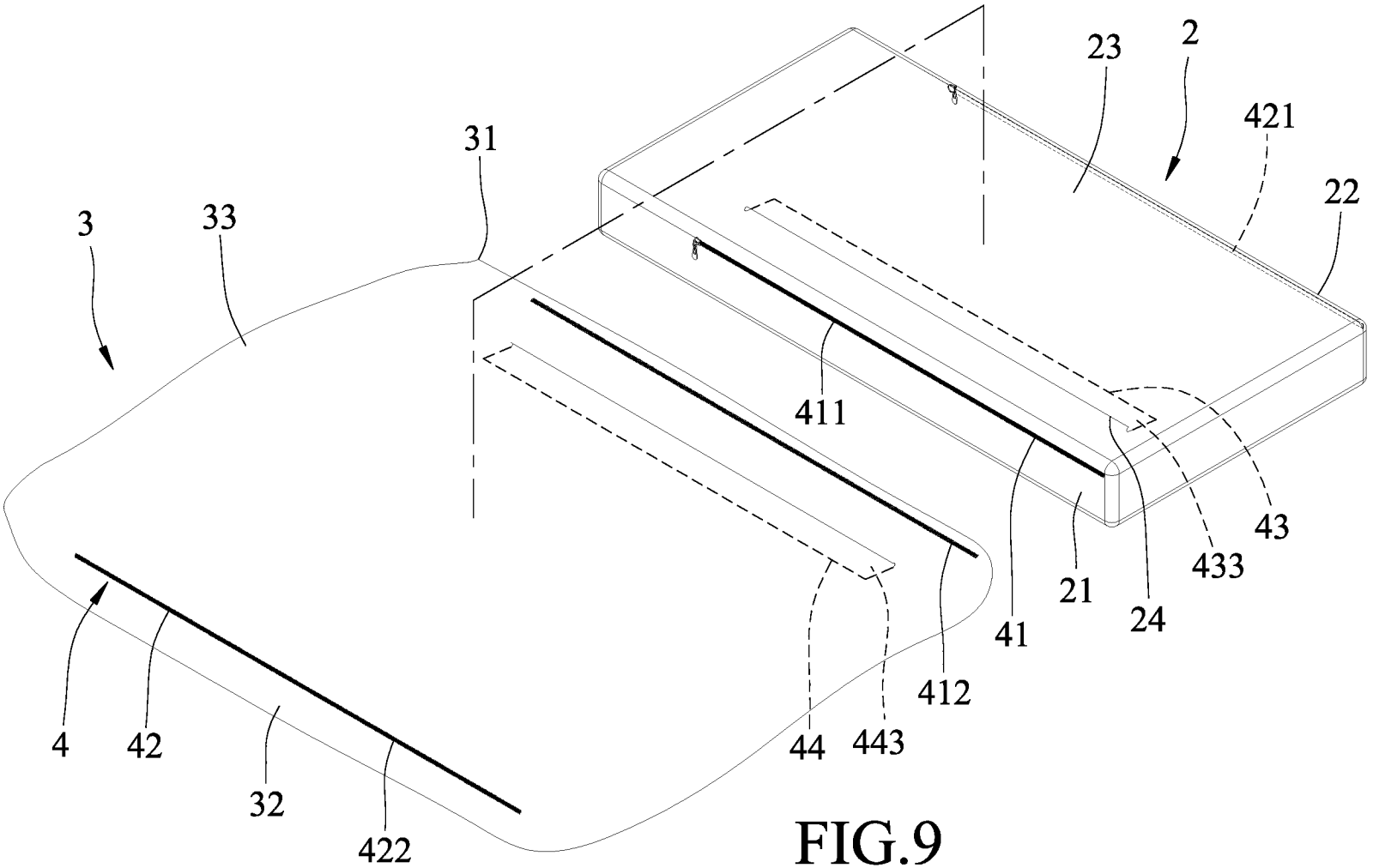
FIG. 9 is an exploded perspective view of the third embodiment.

Referring to FIGS. 8 and 9, a third embodiment of the disclosure is similar to the second embodiment. The reclining portion 23 of the cushion cover 2 has two opening-defining half sections that cooperatively define the cover opening 24. The cover opening fastening subunit 43 has an extending cover member 433 extending from one of the opening-defining half sections of the reclining portion 23 into the cushion space 5, and disposed under the other one of the opening-defining half sections. Also, the covering portion 33 of the top cover 3 has two opening-defining half segments that cooperatively define the access opening 34. The access opening fastening subunit 44 has an extended cover element 443 extending from one of the opening-defining half segments of the covering portion 33 into the insert space 6, and disposed under the other one of the opening-defining half segments.

In summary, the bedding assembly according to the disclosure allows a child to sleep comfortably anywhere by having a cushion 1 inside the cushion cover 2 to support the child's body. The issue of the child kicking off the top cover 3 during sleep is also alleviated, as the first and second coupling subunits 41, 42 ensure that the respective side portions and the cover portions are promptly coupled.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A bedding assembly comprising:

a cushion having opposite lateral surfaces;

a cushion cover defining a cushion space that accommodates said cushion, and having opposite first and second cover portions that are respectively adjacent to said lateral surfaces of said cushion;

a top cover laid on top of said cushion cover and cooperating with said cushion cover to define a reclining space there between, and having opposite first and second side portions that are respectively adjacent to said first and second cover portions of said cushion cover; and a coupling unit including a first coupling subunit that separably couples said first cover portion to said first side portion, and a second coupling subunit that separably couples said second cover portion to said second side portion;

wherein said cushion cover further has a cover opening that is in communication with said cushion space for permitting removal of said cushion therethrough;

wherein said cushion cover further has a reclining portion that is located between said first and second cover portions and that is covered by said top cover, said first cover portion of said cushion cover has a first cover area that is covered by said first side portion of said top cover, said second cover portion of said cushion cover has a second cover area that is covered by said second side portion of said top cover, and said cover opening is formed in one of said reclining portion and said first and second cover areas:

wherein each of said first and second coupling subunits is a zipper;

wherein said top cover defines an insert space therein, and further has an access opening that is in communication with said insert space; and wherein said top cover further has a covering portion that is located between said first and second side portions and that covers said reclining portion of said cushion cover, said first side portion of said top cover has a first side area that covers said first cover area of said cushion cover, said second side portion of said top cover has a second side area that covers said second cover area of said cushion cover, and said access opening is formed in one of said covering portion and said first and second side areas.

2. The bedding assembly as claimed in claim 1, wherein said coupling unit further includes a cover opening fastening subunit that is mounted to said cushion cover and that openably seals said cover opening, and an access opening fastening fastening subunit that is mounted to said top cover and that openably seals said access opening.

3. The bedding assembly as claimed in claim 2, wherein each of said cover opening fastening subunit and said access opening fastening subunit is a zipper.

4. The bedding assembly as claimed in claim 2, wherein:

said cover opening is formed in said reclining portion of said cushion cover; said cover opening fastening subunit has a plurality of cover buttonholes formed in said reclining portion of said cushion cover and being adjacent to said cover opening, and a plurality of cover buttons mounted on said reclining portion and engaging removably said cover buttonholes;

said access opening is formed in covering portion of said top cover; and said access opening fastening subunit has a plurality of access buttonholes formed in said covering portion of said top cover and being adjacent to said access opening, and a plurality of access buttons mounted on said covering portion and engaging removably said access buttonholes.

5. The bedding assembly as claimed in claim 2, Wherein:

said reclining portion of said cushion cover having two opening-defining half sections that cooperatively define said cover opening;

said cover opening fastening subunit has an extending cover member extending from one of said opening-defining half sections of said reclining portion into said cushion space, and disposed under the other one of said opening-defining half sections;

said covering portion of said top cover having two opening-defining half segments that cooperatively define said access opening; and said access opening fastening subunit has an extended cover element extending from one of said opening-defining half segments of said covering portion into said insert space, and disposed under the other one of said opening-defining half segments.

6. The bedding assembly as claimed in claim 1, further comprising an insert that is accommodated in said insert space, and that is removable via said access opening.

* * * * *